United States Patent [19]

Wägli et al.

[11] Patent Number: 4,598,271

[45] Date of Patent: Jul. 1, 1986

[54] CIRCUIT ARRANGEMENT FOR MONITORING NOISE LEVELS OF DETECTORS ARRANGED IN AN ALARM INSTALLATION

[75] Inventors: Peter Wägli, Jona-Wangen; Stefan Temperli, Stäfa, both of Switzerland

[73] Assignee: Cerberus AG, Männedorf, Switzerland

[21] Appl. No.: 582,018

[22] Filed: Feb. 21, 1984

[30] Foreign Application Priority Data

Mar. 4, 1983 [CH] Switzerland ..... 1182/83

[51] Int. Cl.[4] ..... G08B 29/00

[52] U.S. Cl. ..... 340/511; 340/501

[58] Field of Search ..... 340/511, 566, 661, 501

[56] References Cited

U.S. PATENT DOCUMENTS

| | | | |
|---|---|---|---|
| 4,051,467 | 9/1977 | Galvin | 340/511 |
| 4,222,041 | 9/1980 | Von Tomkewitsch et al. | 340/517 |
| 4,333,093 | 6/1982 | Raber et al. | 340/566 |
| 4,348,661 | 9/1982 | Lucchesi | 340/511 X |
| 4,459,583 | 7/1984 | Vanderwalt et al. | 340/661 X |
| 4,470,047 | 9/1984 | Vogt et al. | 340/661 X |
| 4,479,113 | 10/1984 | McNeilly et al. | 340/566 X |
| 4,506,253 | 3/1985 | Mande et al. | 340/511 X |
| 4,517,554 | 5/1985 | Moser et al. | 340/511 X |

FOREIGN PATENT DOCUMENTS

| | | | |
|---|---|---|---|
| 0004911 | 10/1979 | European Pat. Off. | 340/517 |
| 0058824 | 9/1982 | European Pat. Off. . | |
| 0070449 | 1/1983 | European Pat. Off. . | |
| 2341087 | 2/1975 | Fed. Rep. of Germany . | |
| 1529947 | 10/1978 | United Kingdom . | |

*Primary Examiner*—James L. Rowland
*Assistant Examiner*—Brian R. Tumm
*Attorney, Agent, or Firm*—Werner W. Kleeman

[57] ABSTRACT

The circuit arrangement generating at least one noise-level warning threshold monitors the noise-level of detectors in an alarm system. The noise-level warning threshold assumes a fixed relation to the operating or working point level of the signal transmitted by the detector of the alarm system while taking into account shifts in the level of the operating or working point. An alarm storage or buffer disposed in the detector is set without transmitting an alarm signal when the noise-level warning threshold has been exceeded. The noise-level is monitored during normal operation and gives sufficiently early warning of a tendency to generate false alarms.

12 Claims, 3 Drawing Figures

CIRCUIT ARRANGEMENT FOR MONITORING NOISE LEVELS OF DETECTORS ARRANGED IN AN ALARM INSTALLATION

BACKGROUND OF THE INVENTION

The present invention broadly relates to alarm systems or installations and, more specifically, pertains to a new and improved construction of circuitry or circuit arrangement for monitoring the noise-level of detectors in such alarm systems or installations.

Generally speaking, the circuit arrangement of the present invention monitors the noise-level of alarm system detectors having an alarm storage or buffer which is set when an alarm signal is generated and circuitry which generates an alarm threshold and compares it to the signal from the detector.

Alarm systems are employed for detecting and reporting dangers such as forced entry or unlawful intrusions, theft, fire, smoke, gases and so forth. For each of these dangers special detector types have been developed. There are intrusion detectors, fire detectors, smoke detectors , thermal detectors and gas detectors. These detectors can be installed in alarm systems or installations and such systems can include more than one type of detector. Such alarm systems must be constantly functional. They are therefore monitored at definite time intervals for functionality. This monitoring applies to the entire system or installation, including the central reporting or signaling unit or station, as well as to each individual detector. The display showing the momentary state of each detector is also monitored for functionality. If, for instance, a detector has been put into the alarm state, the operator at the central reporting or signaling unit or station must reset it to put it back into functional readiness.

In one known detector, the indication of its alarm state is stored in a so-called alarm storage or buffer which is set when the detector generates an alarm signal. This causes a lamp to light on the detector. After an alarm has been given, the operator must monitor all detectors of the alarm system or installation. The operator must recognize which detector generated the alarm signal and return it to its normal operational state of readiness. This operational state of readiness or reset state is strongly subject to interference by external factors partially beyond the control of the operator or of the system. Such external factors are, for instance, air turbulence, airborne impurities or contaminants, temperature variations and radiation influence. Unfavorable influences also arise from internal sources within individual detectors or within the alarm system or installation, such as aging of and defects in the electronic components.

SUMMARY OF THE INVENTION

Therefore, with the foregoing in mind, it is a primary object of the present invention to provide a new and improved construction of a circuit arrangement for the detectors of an alarm system or installation which does not have associated with it the aforementioned drawbacks and shortcomings of the prior art constructions.

Another and more specific object of the present invention aims at providing a new and improved construction of a circuit arrangement of the previously mentioned type permitting early recognition of susceptibility to signal noise arising from both external and internal sources. The monitoring test can be controlled at the detector itself or from the central reporting or signaling unit or station. In particular, this noise-level monitoring is also possible during active operation of the corresponding detector. Furthermore, the displacement of a working or operating point level of the signal from the detector of the alarm system due to aging processes and component tolerances is continuously taken into account, so that a constant sensitivity for the generation of alarms and noise-level warnings is always assured.

Yet a further significant object of the present invention aims at providing a new and improved construction of circuitry of the character described which is relatively simple in construction and design, extremely economical to manufacture, highly reliable in operation, not readily subject to breakdown and malfunction and requires a minimum of maintenance and servicing.

Now in order to implement these and still further objects of the invention, which will become more readily apparent as the description proceeds, the circuit arrangement of the present invention is manifested by the features that the circuitry which generates an alarm signal threshold and compares it to the detector signal also generates at least one noise warning threshold in predetermined relation to the working or operating point level of the signal from the detector, taking into account any displacement of the working or operating point level, and sets the alarm storage or buffer without transmitting an alarm signal when the detector signal exceeds the noise warning threshold signal.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENTS

Figure 1:
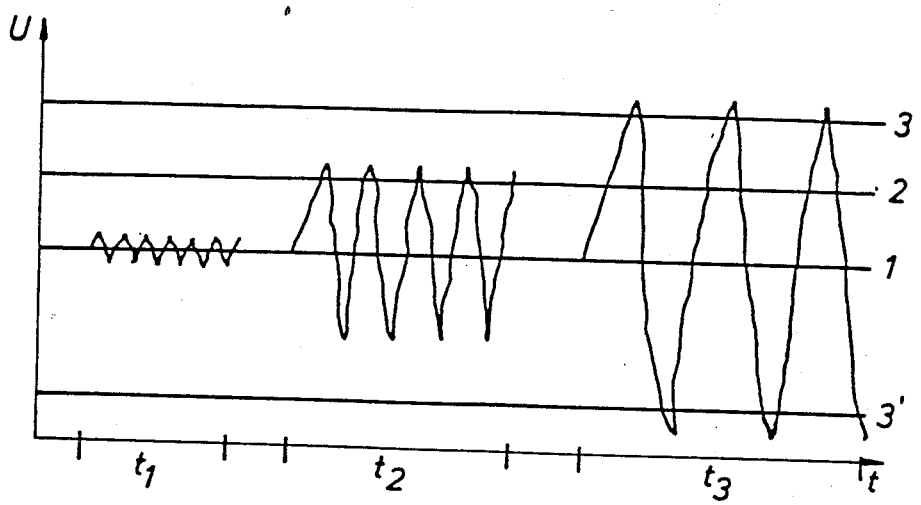
FIGS. 1 and 2 show graphical representations of the relationship of the noise-level warning threshold and the alarm threshold to the operating or working point level of the signal generated by the detector of the alarm system or installation.
Figure 2:
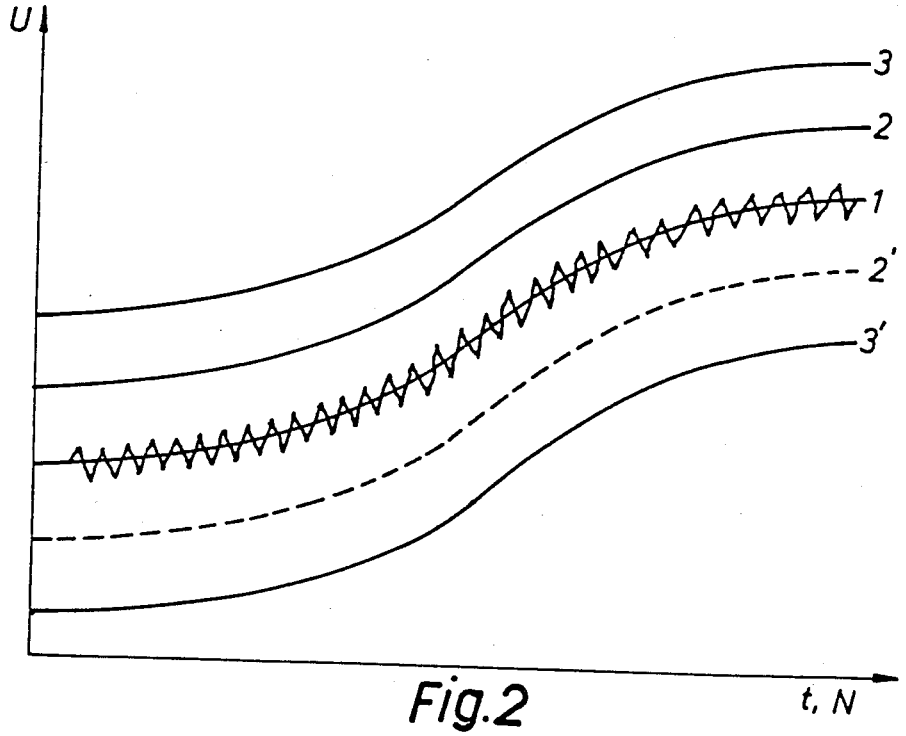

Describing now the drawings, the illustrated exemplary embodiment of the circuitry or circuit arrangement of the invention generates signals or signal levels shown in FIGS. 1 and 2. In FIG. 1, time t is calibrated on the abscissa or horizontal axis of the graph. The ordinate or vertical coordinate of the graph represents the voltage U. The working or operating point level of the output signal generated by the detector element or sensor 4 of the detector of the alarm system on the basis of ambient conditions, such as fire, conflagration, radiation and so forth is represented as a substantially straight line 1 in FIG. 1.

Figure 3:
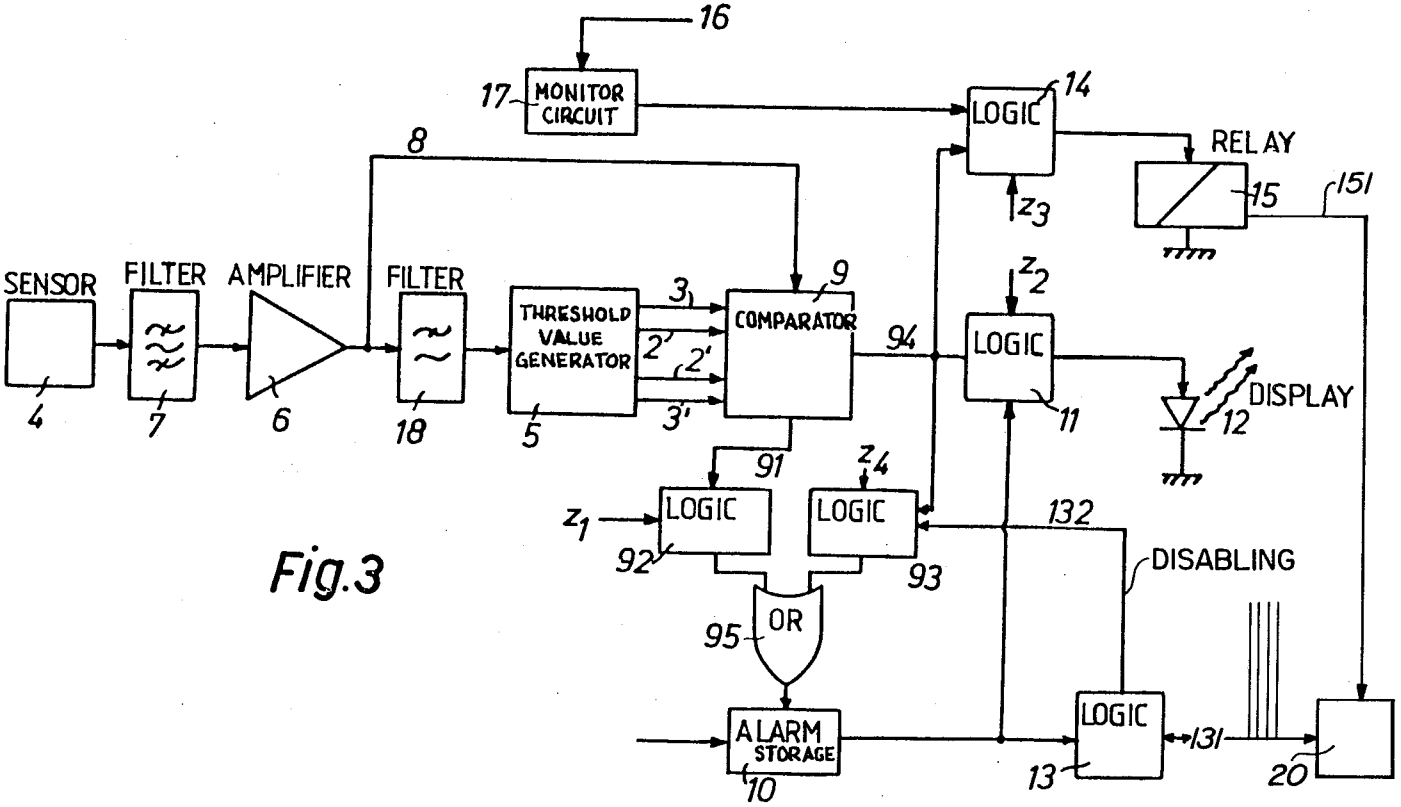
FIG. 3 is a block circuit diagram of an electronic circuit of a detector of an alarm system constructed according to the invention.

In FIG. 1, the output signal of the detector according to FIG. 3 displays a normal amount of signal noise during the time interval t1. In the time interval t2, the output signal of the detector displays an increased amount of signal noise due to internal or external noise or disturbance sources. According to the invention, a noise warning signal or alarm is generated when the threshold value 2 is exceeded. This will be explained in more detail in relation to FIG. 3.

In FIG. 1, the noise threshold 2 is shown on only one side of the working or operating point level 1. This noise threshold can also be applied to both sides of the curve. An alarm state is represented in time interval t3. When the output signal exceeds the upper alarm threshold 3 or drops below the lower alarm threshold 3', or both, an alarm signal is generated by the circuit arrangement of FIG. 3.

FIG. 2 shows the relationship of the output signal to a varying operating or working point level. This variation of the operating or working point level can arise from aging processes of the electronic components, from sample scattering of the component tolerances or from temperature variation. The displacement of the operating or working point level is uncontrollable. The amount and direction of this displacement of the operating or working point level cannot be predicted. Both time t and tolerance scattering N are assigned to the abscissa of FIG. 2. The ordinate shows the voltage U.

Assume that the working point level of the output signal of the detector of the alarm system or installation of FIG. 3 changes in the form of a gently rising curve. The output signal, which is represented as a normal noise curve in this Figure, is centered on this operating or working point level. The noise-level warning threshold 2 maintains a constant relationship to the curve 1 of the operating or working point level of the output signal. It can also be generated as a bilateral threshold 2, 2' as shown in broken line. The alarm thresholds 3 and 3' take the changing operating or working point level into account in the same manner, i.e. they maintain a constant relationship to the curve 1.

In the following, the functioning of the invention will be discussed with reference to the exemplary embodiment of circuit arrangement depicted in FIG. 3. The detector element or sensor 4 generates an output signal corresponding to ambient conditions. Under normal ambient conditions, the detector element or sensor 4 generates an output signal which is represented as a substantially constant value signal overlaid with a normal amount of signal noise in the time interval $t_1$ of FIG. 1 and in FIG. 2. In this case, the circuit arrangement or circuitry of FIG. 3 does not evaluate the signal. The threshold value generator or circuit 5 generates the thresholds 2, 2' 3, 3'. The filters 7 and 18 perform a filtering operation on the detector signal.

Assume now that a noise signal occurs due to either internal or external factors. The output signal of the detector element or sensor 4 now has a greater amplitude which is shown in time interval t2 of FIG. 1. This signal of greater amplitude is transmitted through amplifier 6 and line or conductor 8 to the comparator 9, which compares it with the threshold values 2, 2'. If the output signal exceeds or, respectively, falls below one of these thresholds, then the comparator 9 generates a signal on the line or conductor 91 which transmits it to the input side of the logic circuit 92. In the presence of a suitable state signal $Z_1$ the logic circuit 92 sets the alarm storage or buffer 10 via OR-gate 95. The alarm storage or buffer 10 is set without giving an alarm signal. The state signals, which are either programmed into the detector itself or are transmitted to the detector from the central reporting or signaling unit or station, indicate the current state of the detector or of the alarm system, for instance "enabled" or "monitoring or test operation". It is assumed, for instance, that the installation is switched-on and a positive signal $Z_1$ is applied to the logic circuit 92.

The alarm storage or buffer 10 sends an output signal to the logic circuit 11 which, in the presence of a corresponding state signal $Z_2$, operates a display or indicator 12 mounted on the detector arrangement. This display or indicator 12 can be optical or acoustical. FIG. 3 shows a LED-indicator.

The alarm storage or buffer 10 also sends the same signal to the logic circuit 13, which transmits a corresponding signal through its output 131 to the central reporting or signaling unit or station 20 indicating that the alarm storage 10 has been set but without giving an alarm signal, or to other detectors. A malfunctioning of the detector due to excessive noise-level in the alarm signal is therefore displayed or indicated at the detector itself and is displayed or indicated in the central reporting or signaling unit.

Assume now that the output signal of the detector 4 exceeds the alarm threshold 3 or falls below the alarm threshold 3'. This indicates an alarm condition. The detector signal is transmitted through the amplifier 6 and the line or conductor 8 to the comparator 9 and is compared to the alarm thresholds. The comparator 9 sends an alarm signal through lines or conductors 94 to the logic circuits 11, 14 and 93. In the presence of a suitable state signal $Z_2$, the logic circuit 11 activates the indicator or display 12. The logic circuit 14, in the presence of a suitable state signal $Z_3$ ("enabled" or "monitoring or test operation"), activates the alarm relay 15 e.g. a bistable relay whose contacts generate an alarm signal at the central reporting or signaling unit. The logic circuit 93, in the presence of suitable state signals $Z_4$ ("enabled" or "monitoring or test operation"), sets the alarm storage or buffer 10 through the OR-gate 95. The latter sends a signal to the logic circuit 13 which transmits the corresponding signal through its output 131 to the central reporting or signaling unit or to other detectors or both. There is therefore an indication at other detectors as well as at the central reporting or signaling unit that one detector is in the alarm state. The central reporting or signaling unit now initiates the corresponding measures for dealing with the state of alarm. Those other detectors having received the signal are inhibited from setting their alarm storage or buffer 10 in consequence of ambient alarm conditions by a corresponding ("disabling") signal on the line or conductor 132. This measure assures priority to the detector which first gave the alarm. The other detectors can have the same electronic circuitry as is shown in FIG. 3.

The upper part of FIG. 3 shows the regulated supply voltage i.e. constant current supply of the detector with a monitoring circuit 17. The monitoring circuit 17 responds when the tolerance range of the supply voltage 16 is exceeded due to any external factors. It sends a control signal to the logic circuit 14 which activates the alarm relay 15. The contacts of the alarm relay 15 transmit a further alarm signal via transmitting line 151 to the central reporting or signaling unit that the detector is malfunctioning due to improper current supply.

Finally, it is mentioned that the circuitry 5, 9 also may be located at the central reporting or signaling unit.

While there are shown and described present preferred embodiments of the invention, it is to be distinctly understood that the invention is not limited thereto, but may be otherwise variously embodied and practiced within the scope of the following claims. ACCORDINGLY,

What we claim is:

1. An electronic circuit arrangement for monitoring a signal noise-layer of at least one detector employed in an alarm system comprising:

circuitry connected with said at least one detector and receiving an output signal generated by said at least one detector;

said circuitry generating an alarm threshold signal and comparing said output signal generated by said at least one detector with said alarm threshold signal;

an alarm storage;

said alarm storage being set into a predetermined state when an alarm condition is detected;

said circuitry generating at least one noise-level warning threshold related to a working point level of said output signal generated by said at least one detector;

said circuitry allowing for a displacement of said working point level in generating said at least one noise-level warning threshold; and said circuitry being operatively connected with said alarm storage and setting said alarm storage into a further state without transmitting an alarm signal when said output signal generated by the at least one detector exceeds in value the at least one noise-level warning threshold without exceeding said alarm threshold signal.

2. The electronic circuit arrangement as defined in claim 1, comprising:

indicator means operatively connected with said alarm storage; and said indicator means indicating said predetermined state into which said alarm storage is set only if the alarm system assumes at least one predetermined set condition.

3. The electronic circuit arrangement as defined in claim 1, wherein:

said circuitry is located within said at least one detector.

4. The electronic circuit arrangement as defined in claim 1, wherein:

said circuitry is located in a central reporting unit.

5. The electronic circuit arrangement as defined in claim 1, wherein:

said circuitry comprises a threshold value generator for generating at least one noise-level warning threshold signal corresponding to said at least one noise-level warning threshold;

said threshold value generator further generating said alarm threshold signal; and said at least one noise-level warning threshold signal possessing a reduced level in relation to said alarm threshold signal.

6. The electronic circuit arrangement as defined in claim 5, wherein:

said threshold value generator also generating said alarm threshold signal in relation to said working point level of said output signal generated by said at least one detector; and said threshold value generator maintaining a constant relationship between each one of said alarm threshold signal and said at least one noise-level warning threshold signal with respect to said working point level of said output signal generated by the at least one detector during slow changes in said working point level.

7. The electronic circuit arrangement as defined in claim 1, wherein:

said circuitry comprises a threshold value generator generating at least one noise-level warning threshold signal corresponding to said at least one noise-level warning threshold;

said threshold value generator further generating said alarm threshold signal;

said at least one noise-level warning threshold signal possessing a reduced level in relation to said alarm threshold signal;

the alarm system being capable of assuming a monitoring state;

said alarm storage having a signal input means; and said circuitry containing a logic circuit connected with said signal input means and setting the alarm storage when the level of said output signal generated by said at least one detector exceeds in value said at least one noise-level warning threshold signal without exceeding said alarm threshold signal in said monitoring state of at least part of the alarm system.

8. The electronic circuit arrangement as defined in claim 1, wherein:

said circuitry comprises a threshold value generator generating at least one noise-level warning threshold signal corresponding to said at least one noise-level warning threshold;

said threshold value generator further generating said alarm threshold signal;

said noise-level warning threshold signal possessing a reduced level in relation to said alarm threshold signal;

said at least one detector being capable of assuming a monitoring state;

said alarm storage having a signal input means; and said circuitry containing a logic circuit connected with said signal input means and setting the alarm storage when the level of said output signal generated by said at least one detector exceeds in value said at least one noise-level warning threshold signal without exceeding said alarm threshold signal in said monitoring state of said at least one detector.

9. The electronic circuit arrangement as defined in claim 1, further including:

a central reporting unit operatively connected with said circuitry;

bistable relay means operatively connected with said circuitry; and said bistable relay means transmitting said alarm signal to said central reporting unit.

10. The electronic circuit arrangement as defined in claim 1, further including:

a central reporting unit operatively connected with said circuitry;

bistable relay means operatively connected with said circuitry;

said bistable relay means transmitting said alarm signal to said central reporting unit;

a monitoring circuit for monitoring a supply voltage of the detector; and said monitoring circuit being operatively connected with and tripping said bistable relay means for transmitting a further alarm signal to said central reporting unit if the level of the supply voltage falls below prescribed value.

11. The electronic circuit arrangement as defined in claim 1, wherein:

said circuitry has an input side and generating said at least one noise-level warning threshold in response to the working point level of said output signal generated by said at least one detector and received at said input side of said circuitry.

12. The electronic circuit arrangement as defined in claim 1, wherein:

said at least one detector includes a sensor generating a sensor output signal and being operatively connected with said circuitry; and said output signal generated by said at least one detector being derived from said sensor output signal.

* * * * *